United States Patent [19]

Hamrin

[11] Patent Number: 5,060,397

[45] Date of Patent: Oct. 29, 1991

[54] APPARATUS FOR HEAT TREATMENT OF MATERIAL, PARTICULARLY INFRA-RED RADIATION OF A CONTINUOUS PAPER WEB IN A PAPER MACHINE

[75] Inventor: Karl-Arvid Hamrin, Kungsör, Sweden

[73] Assignee: Infrarodteknik AB, Sweden

[21] Appl. No.: 488,063

[22] PCT Filed: Dec. 13, 1988

[86] PCT No.: PCT/SE88/00675

§ 371 Date: Jul. 5, 1990

§ 102(e) Date: Jul. 5, 1990

[87] PCT Pub. No.: WO89/05883

PCT Pub. Date: Jun. 29, 1989

[30] Foreign Application Priority Data

Dec. 17, 1987 [SE] Sweden ..... 8705033-2

[51] Int. Cl.[5] ..... F26B 19/00; F26B 13/00

[52] U.S. Cl. ..... 34/60; 34/155

[58] Field of Search ..... 34/68, 4, 41, 62, 60, 34/69; 250/497.1, 498.1

[56] References Cited

U.S. PATENT DOCUMENTS

| | | | |
|---|---|---|---|
| D. 249,561 | 9/1978 | Barr . | |
| D. 278,140 | 3/1985 | Tatum . | |
| 2,970,218 | 1/1961 | Shaw . | |
| 3,051,820 | 8/1962 | Krichton . | |
| 3,776,440 | 12/1973 | Frost et al. . | |
| 3,793,741 | 2/1974 | Smith, Jr. . | |
| 3,994,073 | 11/1976 | Lackore . | |
| 4,494,316 | 1/1985 | Stephansen et al. | 34/41 X |
| 4,513,516 | 4/1985 | Bjornberg . | |
| 4,535,548 | 8/1985 | Hyde . | |
| 4,594,795 | 6/1986 | Stephansen . | |
| 4,695,705 | 9/1987 | Kulig . | |

*Primary Examiner*—Henry A. Bennet

*Attorney, Agent, or Firm*—Davis, Bujold & Streck

[57] ABSTRACT

Apparatus (1) for treatment of a continuous paper web (18) in a paper machine by means of infra-red radiation, comprising, in a parallel relation to the paper web, infra-red heaters (17) and protection panes. The protection panes (12) are arranged by way of a series of separate panes overlapping each other and forming ventilation gaps (27), which are directed substantially in parallel relation to the web in the same direction or in two opposite directions.

6 Claims, 2 Drawing Sheets

2/2

Figure 1:
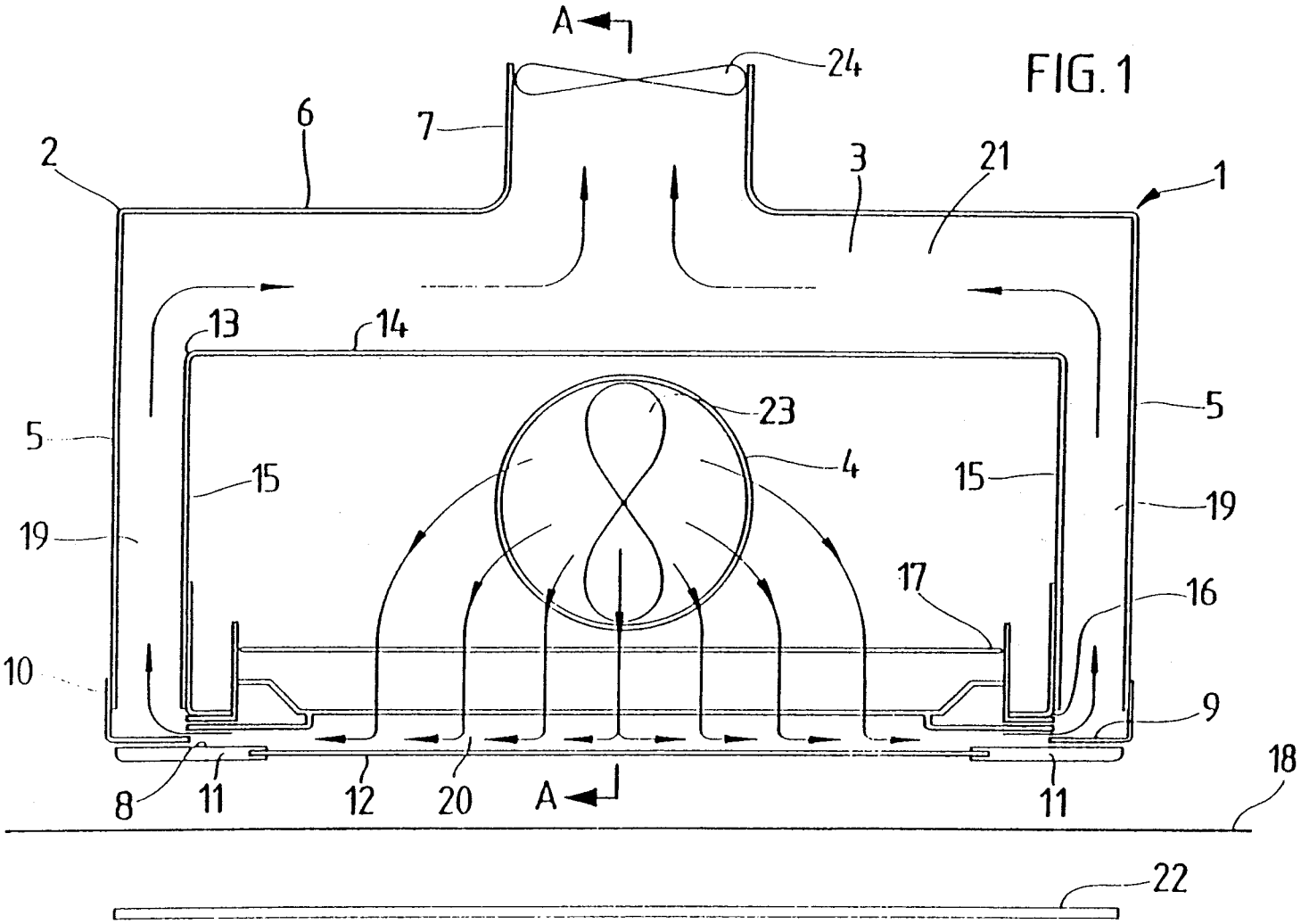

APPARATUS FOR HEAT TREATMENT OF MATERIAL, PARTICULARLY INFRA-RED RADIATION OF A CONTINUOUS PAPER WEB IN A PAPER MACHINE

The present invention relates to an apparatus for heat treatment of material, particularly infra-red radiation of a continuous paper web in a paper machine and is more closely defined in the preamble of claim 1.

It is previously known to expose e.g. a continuous paper web in a paper machine to infra-red radiation for drying the web wholly or partially. Hereby, the infra-red radiation creates a great heat potential, which entails the need for cooling the radiation and protection of the paper web against smear spots and other polution, the risk of fire and unequal drying. For achieving such a protection, supply and/or exhaust air currents are used, which affect the radiation and the paper web. These currents are provided to bring about guaranteed cooling, but without minimizing the efficiency of the drying process and without adversely affecting the path of the web, respectively. These demands have, so far, not been met by previously known techniques.

Such apparates do often comprise a s.c. counter reflector provided to throw back part of the heat radiation having passed through the paper against same. It is desirable, for making the drying process more efficient, to arrange the counter reflector as close to the paper web as is possible. Hitherto, the counter reflector had, however, to be arranged at relatively large distance to the paper web, for various reasons, which brought about decreased efficiency. The same applies to the reflector itself with the radiation source which, mainly because of security reasons, had to be arranged at relatively large distance from the paper web in previously known apparates, which rendered a clearly worse degree of efficiency. Of major importance in this connection is, however, the guidance of the web, which so far, for certain combinations of paper weight, structure, moisture contents, free length in the direction of the web etc, has been adversely affected by reflectors arranged too closely nearby, because of negative affects of the cooling air currents on the web. Further drawbacks of known techniques are great waste of power, difficulties to perform maintenance and service, maintaining an equal degree of efficiency and need for frequent service.

The object of the invention is to provide an improved apparatus of the kind as initially defined, which avoids the said drawbacks. A superior purpose of the invention is to provide a basis for using the components comprised by the apparatus as efficiently as possible, to increase the level of efficiency substantially and to provide, in spite of these advantages, the same or even increased security. A further object of the invention is to improve techniques in this field in various other respects.

These objects are achieved according to the invention in that an apparatus of the kind as initially defined substantially is characterized by the features of the characterzing clause of claim 1. Thanks to these features, it is possible to arrange the radiator with the reflector very close to e.g. a paper web, namely, according to obtained test results, at 20 mm distance between protective glas panes and a paper web, which is to compare with app. 50 mm according to previously known technique. In such a way, a much more extensive drying is, of course, obtained and the level of efficiency may be increased further by arranging even the counter reflector closer to the web. In spite of these features, it is possible to ensure an advantageous web guiding, which is not or only negligibly affected by e.g. air currents. Said features do also safeguard, that the apparatus is, as far as possible, kept free from dirt. The lack of substantial free air currents brings about a degree of purity which is unknown so far, and which considerably increases both efficiency and safety.

Furthermore, the concept of overlapping protective panes offers the advantage, that tolerances and thermical expansion won't affect the tightness of the assembled glas surface.

Further characteristics of and advantages with the invention are revealed by the following specification with reference to the accompanying drawings which, schematically, illustrate a preferred, though not limiting example.

Figure 2:
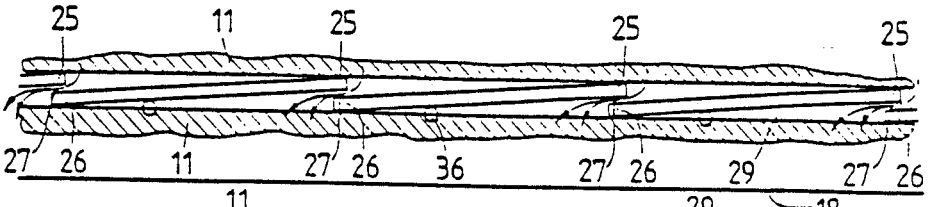
Figure 3:
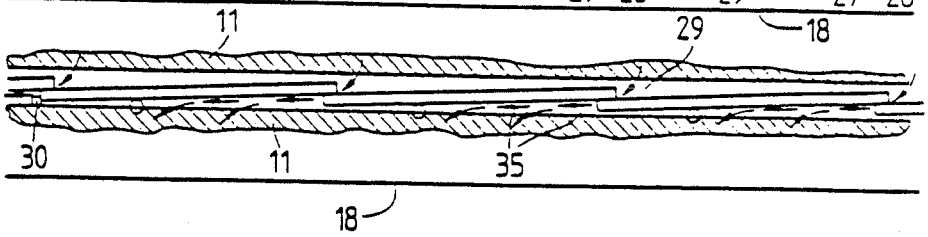
Figure 5:
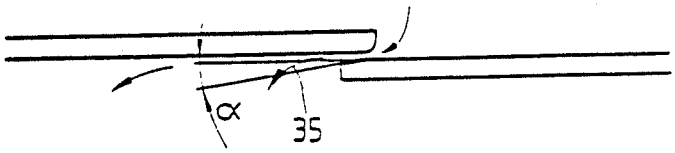
Figure 4:
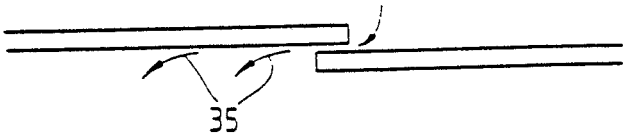
Figure 6:
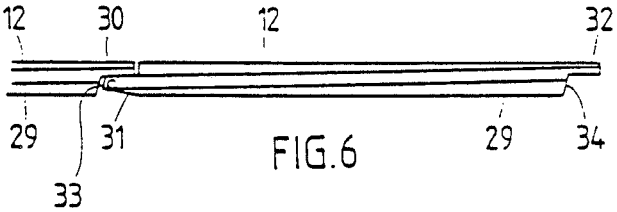
Figure 7:
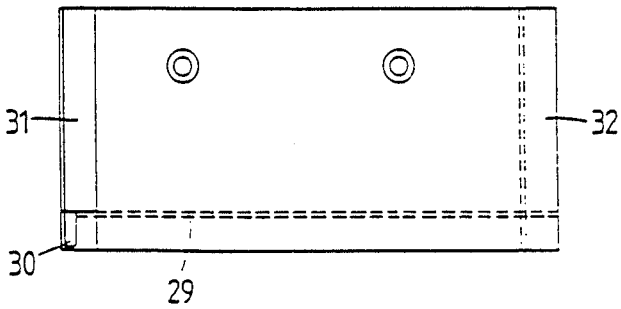

FIG. 1 is a cross-sectional view of an apparatus according to the invention, FIG. 2 is a sectional view according to line A ./. A in FIG. 1 illustrating conditions at relatively low pressure, FIG. 3 is a view corresponding to FIG. 2 at relatively high pressure, FIG. 4 is a partial view of the embodiment according to FIG. 2 or an embodiment between FIG. 2 and 3, FIG. 5 is a view corresponding FIG. 4 of a modified embodiment, FIGS. 6 and 7 are a side elevational view and a top plan view, respectively, of a preferred embodiment of a pane holder.

In FIG. 1, 1 designates a preferred embodiment of an apparatus according to the invention in its entirety. The apparatus comprises e.g. an elongated exterior housing 2 provided in one end wall 3 with an inlet 4, side walls 5 and a top side 6 with an outlet 7. Lowermost, the exterior housing shows an opening 8 occupying substantially the underside and laterally limited by narrow flanges 9, which preferably are provided at a border 10 extending all-around the side walls 5 and the end walls 3 and permitting easy and complete access to the interior of the exterior housing.

From below, pane holders 11 are attached to the flanges 9 and carry panes 12, which in principle cover the opening 8. Appearance and function of the pane holders will be more closely described in connection with FIG. 2–5.

Between the end walls 3, there extends an interior housing 13 with top side 14, side walls 15 and a lower opening 16, which is occupied by infra-red heaters 17 with reflectors (not shown) inserted into the interior housing and facing a paper web 18, which is guided outside of the panes 12 and parallel to these. The web runs to the left or to the right in FIG. 1.

The side walls 15 of the interior housing are arranged at distance from the side walls 5 of the exterior housing in order to provide exhaust air passages 19, which connect a lower supply air zone 20 between said heaters 17 and the inside of the panes 12 to an upper merging passage 21 between the top sides 6 and 14, which merging passage extends into said out let 7 to lead away the exhaust air. The supply air and the exhaust air are thus guided in a closed system.

Herein, the supply air is preferably filtered before entering the apparatus according to the invention. The exhaust air may wholly or partly be used in e.g. heat exchangers or other energy using devices. The exhaust air is supplied in a pure state and does not require filtering, accordingly. The housings are suitably made of stainless steel.

On the reverse side of the paper web, there is preferably provided a counter reflector 22, which is previously known per se and has the objective to throw back the major part of the radiation which has penetrated the paper web and in this way heat up the latter even on that side which is turned away from the heaters 17. Thanks to the invention, even the counter reflector can be arranged relatively close to the paper web, e.g. 20 mm from same, while that distance previously was app. 50 mm.

As revealed by FIG. 1, the supply air is distributed from the inlet or inlets 4 around and/or through the heaters 17 and through the supply air zone 20, which thus becomes a cooling zone, towards both sides 5. The pressure of the supply air may easily be adjusted in that the inlet 4 is connected to a fan 23 generating excess pressure and/or in that the outlet 7 is connected to a fan 24 generating a vacuum. Possibly, a fan for the exhaust air is unnecessary thanks to the invention.

According to another, substantial feature of the invention, the panes 12 are arranged in series throughout the length of the exterior housing, i.e. at right angle in relation to the sheet plane of FIG. 1. The panes bridge the entire distance between the juxtaposed pane holders 11 in one piece and have thus a length of 250–600 mm, preferably app. 350 mm. The width is preferably 100–300 mm only, suitably app. 150 mm. This width shows up in FIGS. 2 and 3, which also reveal another important feature of the invention, namely that the longside regions 25, 26 of the panes overlap each other. The overlap is such that gaps 27 are formed which either all of them point in the same direction or, for instance, commencing at the center of the apparatus, point in opposite directions.

The pane holders 11 are shown schematically only in FIGS. 2 and 3. They may be provided in a continuous way for receiving any number of panes or e.g. a pane each. They are furnished with a groove 29 for receiving the pane or panes. This groove may be so wide, that an overlap is possible within the groove, i.e. the groove is at least twice as wide as the thickness of the panes. It is also possible to provide several grooves 29, one for each pane, and/or may the grooves and/or the pane holders be oblique in a way as illustrated by the grooves 29 in FIG. 6. Furthermore, within or outside of the grooves and at their lower end there may be stop means 30, which limit insertion of the panes in this direction. According to a special embodiment of the invention, these stop means may be provided to form or prolong or limit or affect, respectively, wholly or partly said gaps 27. A preferred embodiment is shown in FIGS. 6 and 7, where the holders form, in the direction of inclination, a lower projection 31, on which there is provided to rest an upper projection 32 arranged at the opposite side of the holders. The front edge of the lower projection 31 and the matching edge of the upper projection 32 may preferably be oblique for easier fitting in.

The edges of the panes entering the grooves 29 may be furnished with some kind of lining, packing or the like (not shown), which may have a certain elasticity for desirable adjustment or regulation of the width of the gaps 27. In principle, at low pressure drop via the gaps 27, the panes attain a position according to FIG. 2, where supply air leaks through the gaps 27 in a controlled way. The flow points in the same direction and somewhat away from the panes and soewhat towards the paper web, which may be advantageous in certain cases. Mostly, a control according to FIG. 3 or closely to FIGS. 3, 4 or 5 may, howver, to be preferred. Herein, most a relatively large pressure drop prevails via the gaps 27, which decrease in width simultaneously due to this pressure drop, as the superposed pane area 25 is pushed down towards the underlying area 26 of the adjacent pane by the pressure. In this way, an automatic self-adjustment is always achieved, which cannot be affected even by wear and tear as time goes by. Within the gap itself, a lower pressure arises, thanks to which the pane areas superimposing each other are so to speak sucked towards each other. Through the very narrow remaining gap, high velocity air currents 35 are pushed out in parallel relation to that side of the panes which faces the paper web, which pane sides simultaneously are kept clean and cooled thanks to these currents, which benefit, due to velocity and substantial momemtum, from the s.c. coanda effect, i.e. that an air current is sucked towards a confinement by the arising vacuum. The volume of these air currents is however, so little, that the guidance of the web is not adversely affected in any way. An advantage in this connection is also, that the partial currents assist each other by a combined sucking and pushing effect. The power of a partial stream may therefore not be chosen in such a way, that the stream or current easily and quickly can leave the region between panes and paper web, which likely could give rise to turbulences entailing interferences in the guiding of the web. Very favourable is the laminar flow of air between panes and paper web. At high pressure drop, the flow direction is, as has been said, substantially parallel to the panes, which may be further improved by narrow and possibly long gaps, which are achievable by choosing longer overlap zones. At low pressure drop, it may be favourable to direct the air currents slightly more towards the paper web for better breaking up a steam layer surrounding the web. This flow pattern may accordingly be controlled, among other means, by control of the pressure drop. Naturally, there may be provided special means for increasing/decreasing the width of the gaps, e.g. by way of s.c. pivot points 36, around which the panes may turn or be turned simultaneously increasing or decreasing the gap width. Another means may be shaping the pane edges within the overlap zones e.g. by bevelling and/or curving which, to a certain degree, may have the effect of diffusing and/or increasing velocity. The pane edges may also, in these areas, be ground in a special way to form, in combination, a ceratin desired jet design and thus render an increased length of throw respectively velocity at a certain difference of pressure. Even in this way, the length of the gaps may be controlled.

Thanks to the invention, panes and infra-red heaters may readily be for instance exchanged, which is a favourable spin-off effect of the invention, which is to be compared with removing a large pane with many points of attachment, large weight and other discomfort.

It will be appreciated, that the panes may be arranged alternately at different levels which, admittedly, will result in pairs of air currents pointing in opposite directions, which currents may, however, be designed differently or is it possible to obstruct one gap formation.

I claim:

1. Apparatus (1) for heat-treatment of a web of material of a continuous paper web (18) in a paper machine, comprising a number of infra-red heaters (17) arranged in parallel relation to the web and separated from the web by protection glass (12), a cooling air system being provided to cool the infra-red heaters and the protection glass, characterized in that the protection glass (12) is provided as a series of separate panes overlapping each other and forming ventilation gaps (27), which are directed substantially in parallel relation to the web.

2. Apparatus according to claim 1, characterized by an elongate exterior housing (2) with an inlet (4) for the web in any end wall (3), side walls (5) and a top (4) and with an outlet (7) for the web in an opposite end wall (3), an opening (8) occupying substantially the entire underside and being laterally confined by flanges (9) at the side walls (5).

3. Apparatus according to claim 2, characterized in that between the end walls (3) there extends an interior housing (13) having a top (14), side walls (15) and a lower opening (16), which is covered by infra-red heaters (17) with reflectors, in said interior housing, oriented to face the web (18) through the glass panes, the side walls (15) of the interior housing being arranged at distance from the side walls (5) of the exterior housing to form therebetween exhaust air passages (19), which interconnect a lower supply air zone (20) between said heaters (17) the panes (12) with an upper exhaust passage (21) between the tops (6) and (14), the exhaust passage being connected to the outlet (7) for removing exhaust air.

4. Apparatus according to claim 2, characterized by a counter reflector (22) which is located 20 to 33 mm from the web remote from the heaters (17).

5. Apparatus according to claim 2, characterized in that the panes (12) are arranged in series along the length of the exterior housing, that the panes each bridging the entire distance between opposite pane holders (11) attached to the flanges (9) of the side walls, and that the pane holders (11) are each designed to hold at least one pane.

6. Apparatus according to claim 5, characterized in that the pane holders are provided with grooves (29) to receive the panes, the grooves having such a width, that the overlap takes place within the grooves.

* * * * *